US005202529A

United States Patent [19]

Shields

[11] Patent Number: 5,202,529

[45] Date of Patent: Apr. 13, 1993

[54] CONVERTIBLE AMMUNITION RELOADING PRESS

[75] Inventor: Steven R. Shields, Oroville, Calif.

[73] Assignee: Blount, Inc., Portland, Oreg.

[21] Appl. No.: 806,909

[22] Filed: Dec. 16, 1991

[51] Int. Cl.[5] ..... F42B 33/02

[52] U.S. Cl. ..... 86/23; 86/24

[58] Field of Search ..... 86/23, 24, 27, 28, 33, 86/37, 40, 44

[56] References Cited

U.S. PATENT DOCUMENTS

| | | | |
|---|---|---|---|
| 4,031,804 | 6/1977 | Boshi | 86/23 |
| 4,841,831 | 6/1989 | Bender et al. | 86/27 |
| 5,024,135 | 6/1991 | Bender | 86/31 |

*Primary Examiner*—Brian S. Steinberger
*Attorney, Agent, or Firm*—Robert L. Harrington

[57] ABSTRACT

A reloading press that is convertible between different capabilities. The press utilizes a basic structure to which interchangeable conversion sets are individually mounted to provide a reloading press with a capability. To change the capability of the press, one conversion set is interchanged with another. The interchange of the conversion sets permits a user to convert the reloading capability of the press such as from a single station to an indexable multiple station. The conversion sets include top plates for holding a tool or tools, and a shell holder mountable to the ram. Components may be added or interchanged between conversion sets to convert the capability of the press further such as converting from one caliber to another or converting a multiple station press from manual to automatic indexing. The basic structure utilizes a rugged support extending from the base for supporting the interchangeable top plates.

3 Claims, 7 Drawing Sheets

CONVERTIBLE AMMUNITION RELOADING PRESS

BACKGROUND INFORMATION

1. Field of the Invention

This invention relates to reloading presses for spent cartridge cases and in particular it relates to a basic reloading press and interchangeable conversion sets individually mountable to the basic press to provide a press of one configuration and interchange of the conversion sets providing convertibility of the configured press as between single station, multiple station, and functional capability.

2. Background of the invention

Individuals reloading ammunition desire easy-to-use, rugged, accurate, reliable equipment to perform the reloading operations. The user desires a tool that will rapidly and accurately perform the necessary functions required in a reloading operation, such as lubricating the case prior to resizing, depriming the case, installing a new primer, resizing the case, dispensing a throw of powder, and seating and crimping the bullet. Reducing the cost of ammunition is of course one of the reasons individuals reload ammunition. Tooling costs are a important consideration in the reloading operation.

A novice or beginner will typically invest in a single stage press to perform the reloading operations. The single stage press is arranged to accept a single reloading die and the user will perform an operation on a number of spent cartridge cases using one die, change the die and then perform a second operation on the same cartridge cases. The user will continue, changing dies as required, until all of the reloading operations are completed. This is of course time consuming and requires separate handling of the cases between operations. As the individual gains in knowledge and improves on the reloading skills, the individual will look to other tooling and methods that will simplify and reduce the time required to perform the operations.

One of the ways to accomplish this end is the use of a multiple station reloading press. The multiple station reloading press is arranged for multiple dies and a case is presented to each of the dies in sequence to perform the reloading operations. Thus as the press is cycled, an operation is performed on a cartridge case in one station then indexed to the next station where another operation is performed on the case and so on until all of the operations required are completed. As will be appreciated, the time required is greatly reduced and the cases do not require handling between the operations.

There are some add on kits for converting a single stage press to the multiple stage. The kit is fastened to the die holder and extends upwardly from the top of the single stage press. The kit requires a base and an upper plate for holding the multiple dies and structure to support the upper plate above the add-on base as well as an indexing shell holder. The kit although converting the single stage press to a multiple stage duplicates much of the basic structure, i.e, the base, the top plate and supporting structure. Duplication of the structure of course adds to the cost. The commonly assigned U.S. Pat. No. 4,841,831 discloses such a kit for adapting a single station press to a multiple station.

BRIEF SUMMARY OF THE INVENTION

The present invention is a press system that utilizes a basic press structure or foundation. Different sets of shell holder/tool holder components are added to the foundation to assemble presses of different configurations and functional capabilities. (These sets of components are sometimes herein referred to as conversion sets.) The basic press structure has a base, a moveable ram and support structure extending from the base. The support structure supports interchangeable die holding plates. The ram is configured for the mounting of interchangeable shell holding mechanisms. The conversion sets include a die holding top plate and a corresponding shell holding mechanism. The basic press by utilization of the interchangeable conversion sets may be configured as a single station press, a multiple station press with manual indexing and a multiple station press with automatic indexing. The press of one configuration ma be converted to a press of another configuration by merely interchanging the appropriate conversion sets. The utilization of a basic press structure and interchangeable conversion sets minimizes the parts required and maintains the basic structural integrity for all applications.

The basic press is configured as a single station press by adding a conversion set having a top plate arranged to hold one reloading tool and a shell holder arranged to hold a single cartridge case. The basic press is configured as a multiple station press by adding a conversion set having a top plate arranged to hold multiple reloading tools and a shell holder arranged to hold multiple cartridge cases. The shell holder is rotatably mounted to the ram and is indexable to sequentially have a cartridge case to each of the multiple stations. The multiple station press may be arranged for either manual or automatic indexing. Any press configuration may be changed over to another configuration by interchanging the appropriate conversion sets.

It will be appreciated from the above and the following detailed description that this invention is not restricted to a specific type of ammunition. Whereas a metal rifle type shell is illustrated, the invention is applicable to reloadable shells or casings in general including non-metallic a well as metallic casings and shot shell as well as rifle type casings. Accordingly, as that term is used herein, "cartridge cases" encompasses all such reloadable ammunition casings.

Refer now to the drawings and the description of the preferred embodiment for a complete understanding of the invention.

DESCRIPTION OF THE PREFERRED EMBODIMENT

Figure 1:
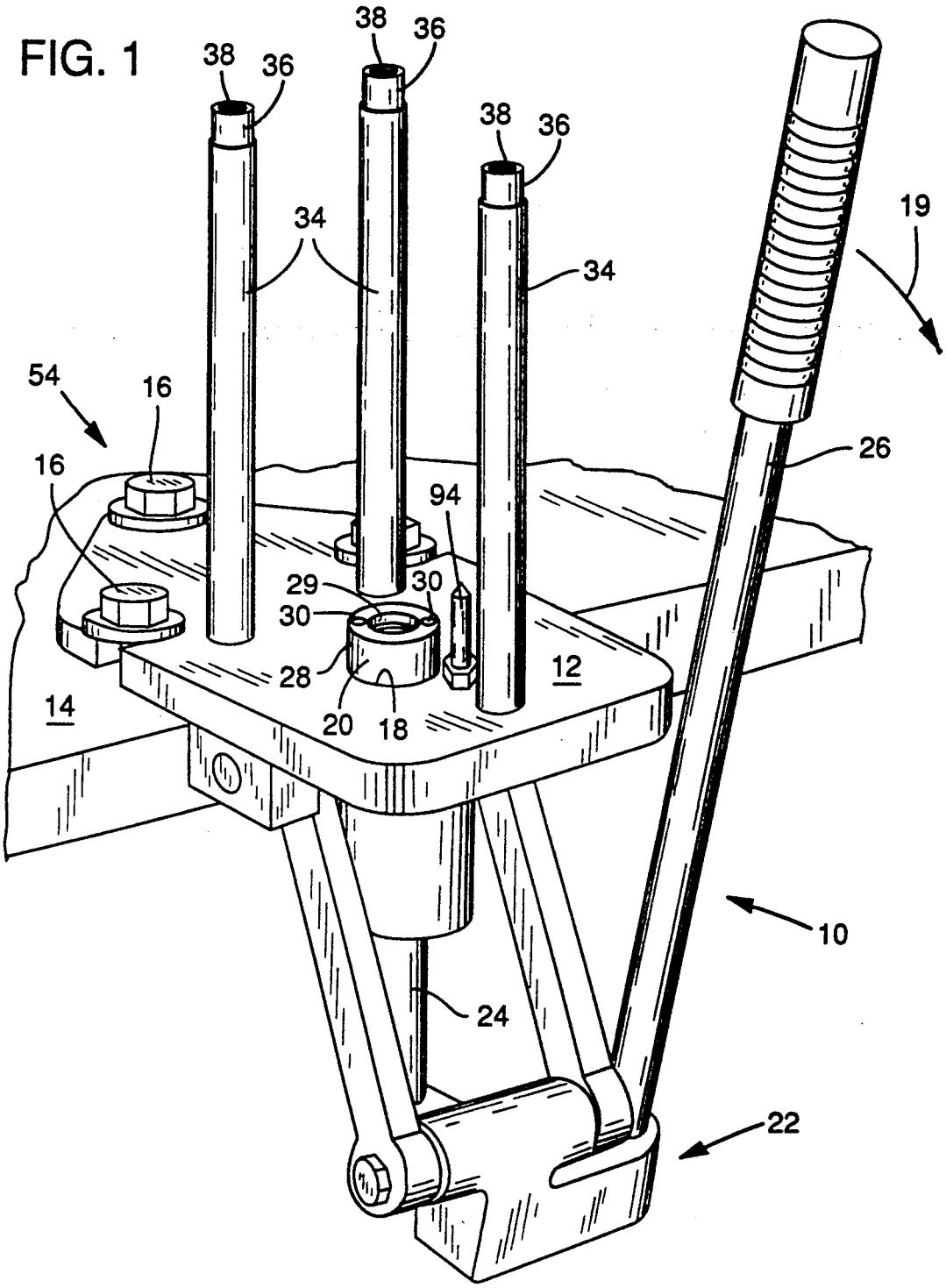
FIG. 1 is a perspective view of the basic press of the present invention.

Refer now to FIG. 1 of the drawings. It illustrates a basic press 10 which is the foundation for assembling added components to produce a press to suit the requirements of a user. The basic press 10 is the foundation utilized to construct presses of varying functional capabilities by the addition of interchangeable components. As will be explained the basic press 10 is the basis for constructing or assembling a single station press, a multiple station press with manual indexing and/or a multiple station press with automatic indexing. Each configuration may be converted or changed to another configuration with minimum parts changeover. As will be seen the basic press 10 minimizes the structure required to fulfill any one of the configurations.

As illustrated in FIG. 1, the basic press 10 has a base 12 for mounting the press to a support structure 14, such as a work bench by fasteners 16 in a conventional manner. A bore is provided in the base 12 for mounting an index locating pin 94 which is utilized in the multiple station presses and will later be explained. A bore 18 is provided in the base 12 for receiving a moveable ram 20; the ram 20 being moveable upwardly and downwardly (as viewed in the figure) by actuating a compound lever assembly 22 fitted to the underside of the base 12 and attached to the lower end 24 of the ram 20. The compound lever assembly 22, such as illustrated, is well known in the art and a detailed description will not be provided. As is known, movement of an operating handle 26 of the lever assembly 22 in the direction indicated by the directional arrow 19 moves the ram upwardly and movement of the handle 26 in the opposite direction moves the ram downwardly (again as viewed in the figure).

The upper end 28 of the ram 20 has a threaded center bore 29 and a pair of screw holes 30 for the removable mounting of interchangeable shell plate holders and/or shell holder adapters, as applicable.

Fixedly attached to and extending upwardly from the base 12 are three columns 34. The lower ends of the columns 34 are threaded and fit in threaded bores in the base 12 in a conventional manner. It is preferable to have the threaded end of the column of a smaller diameter so a shoulder is formed which will abut the top of the base 12 upon installation of the columns 34. The columns 34 extend upwardly from the base 12 parallel to the travel path of the ram 20. The columns 34 are positioned radially around the bore 18 with the bore 18 being centrally positioned in reference to the columns 34. The upper ends 36 of the columns 34 terminate at a common plane and the extended ends 36 of the columns are of reduced diameter, i.e., they are stepped so as to form a shoulder. Each column 34 has a drilled and tapped bore 38 in the extended end as illustrated for securing interchangeable structures, such as top plates as will be explained.

Figure 2:
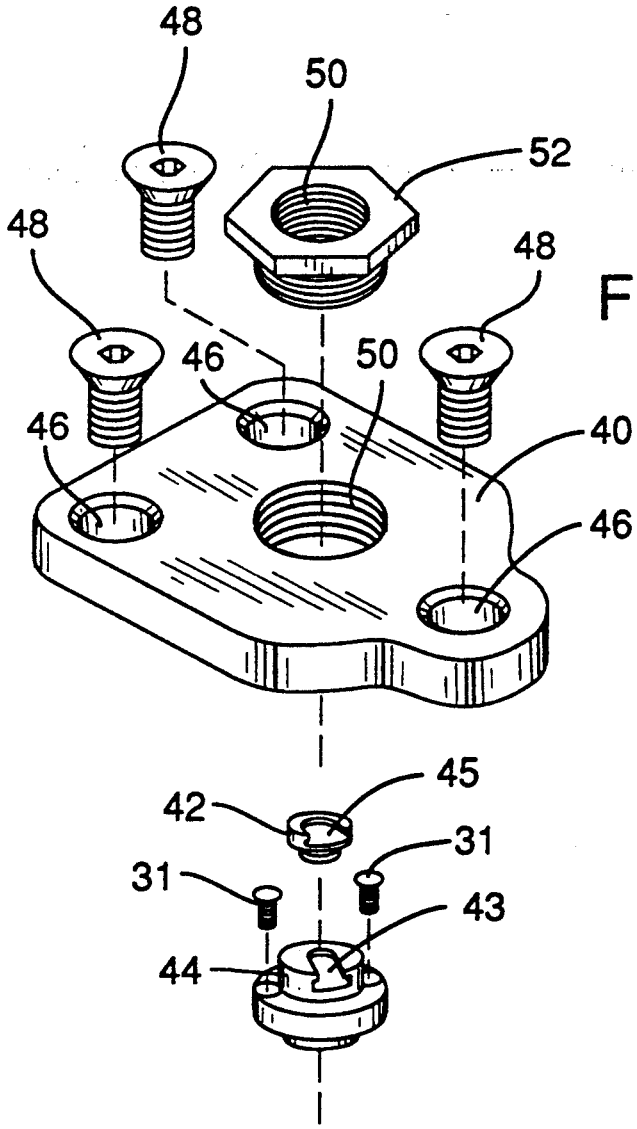
FIG. 2 is a view of a single stage top plate and shell holder for the press of FIG. 1.
Figure 3:
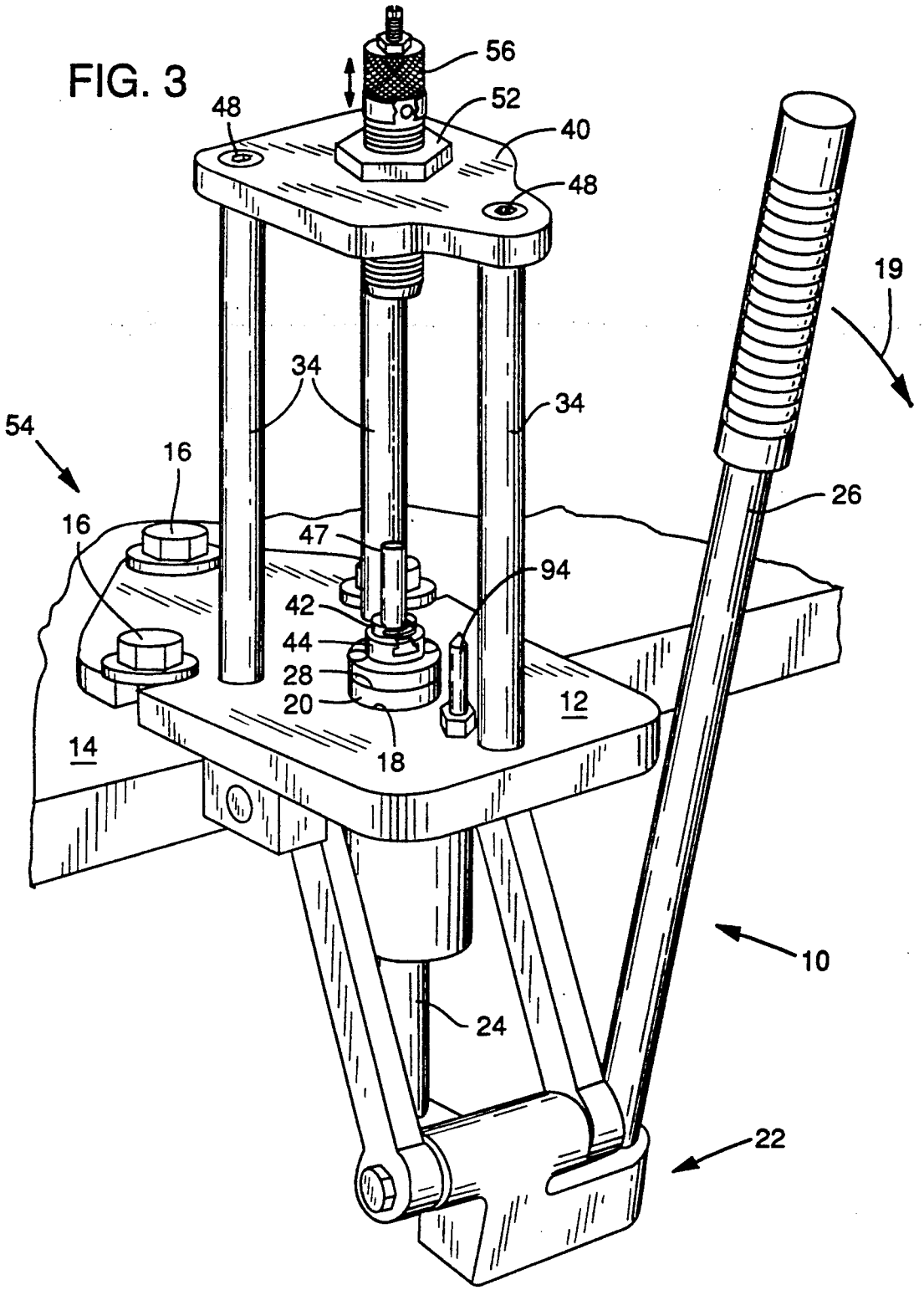
FIG. 3 is a view of the press of FIG. 1 arranged as a single stage press.

Refer now to FIG. 2 of the drawings which illustrates a conversion set comprising a top plate 40, a shell holder 42 and a shell holder adaptor 44 that is added to the foundation (i.e. press 10) to complete the assembly shown in FIG. 3 for a single station reloading press 54. With reference also to FIG. 1, note that the top plate 40 has three through-bores 46 strategically positioned for mounting the top plate 40 on the ends 36 of the columns 34. The top plate 40 is fitted to the columns 34 with the underside of the top plate abutting the formed (stepped) shoulders on the extended ends 36 of the columns 34 and is secured to the columns 34 by threaded fasteners 48 in a conventional manner. The top plate 40 has a central through-bore 50 that is threaded for receiving a die bushing 52 which in turn receives a reloading tool such as a sizing die. Removal of the bushing permits the use of larger diameter dies. The top plate 40 mounted on the columns 34 is in the travel path of the ram 20.

Screws 31 secure the adapter 44 to the ram end 28 as illustrated in FIG. 3. (The threaded bore 29 may be utilized, e.g., for the dual attachment of a shell holder for large caliber shells, e.g. 50 caliber. Only screw holes 30 are utilized for the embodiments disclosed.) A conventional transverse slot 43 on the upper end of adapter 44 is used for mounting the shell holder 42 in a conventional manner. The shell holder 42 has a slot 45 for receiving a cartridge case. The top plate 40 is to be paired with an adapter 44 and shell holders 42 may be individually acquired to meet the user's specific needs. Thus when changing the caliber of a case to be reloaded which requires a different shell holder, only the shell holder need be changed. The reloading tools received in the top plate 40 would of course be changed to suit the caliber as required.

Refer now to FIG. 3 of the drawings which illustrates the conversion set of FIG. 2 (top plate 40, the shell holder adaptor 44 and multiple shell holders 42 as desired) mounted to the basic press 10 to assemble a single station press 54. As shown the top plate 40 is mounted to the ends 36 of the columns 34 with an assembly of a bushing 52 and a reloading tool 56 mounted in the central bore 50. The shell holder adaptor 44 is mounted to the end 28 of the ram 20 and the shell holder 42 is mounted on the shell holder adaptor 44. A cartridge case 47 inserted in the shell holder 42 is aligned with the die 56. Thus as the ram is cycled to move upwardly, the cartridge case will be presented to the die 56.

Figure 4:
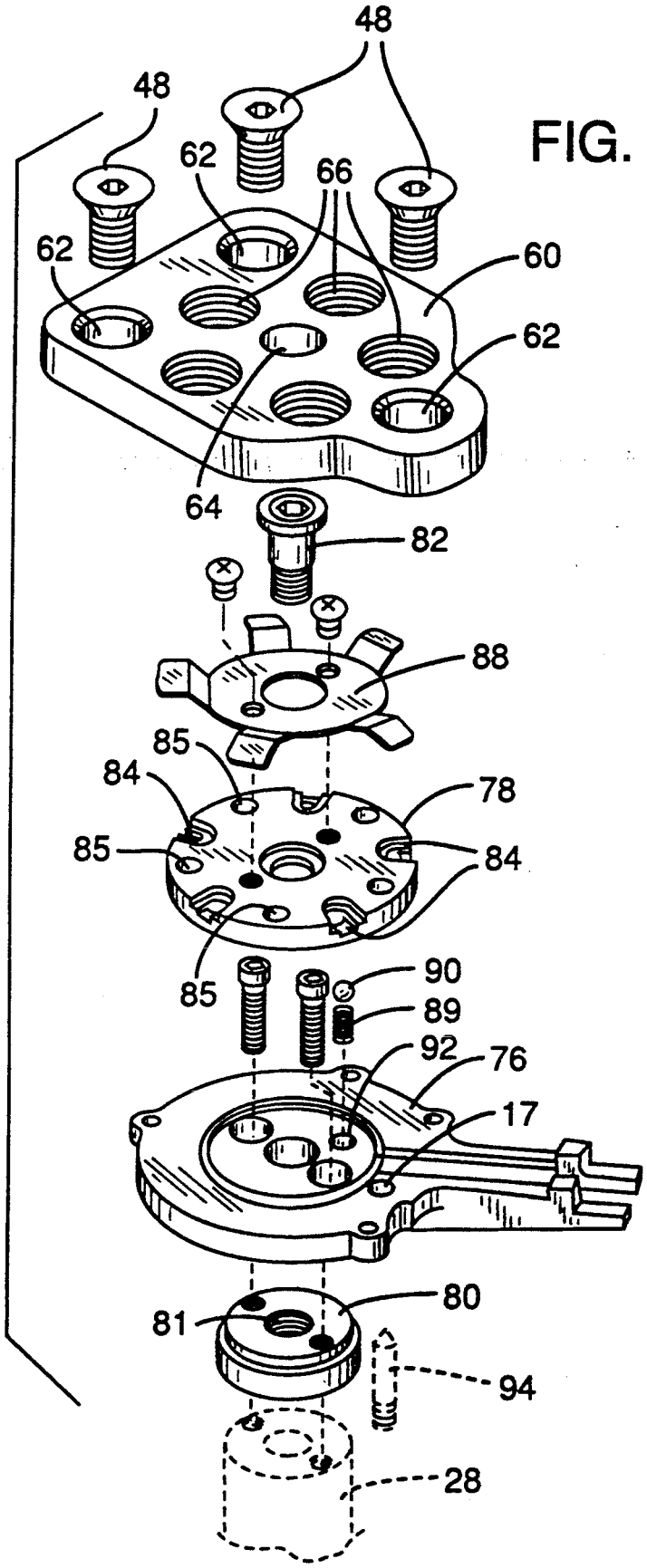
FIG. 4 is view of a multiple stage top plate, shell plate holder and shell plate mountable to the press of FIG. 1.

Refer now to FIG. 4 of the drawings which illustrates a conversion set to be added to the basic press 10 to assemble a multiple station press 96. A top plate 60 has three through-bores 62 strategically positioned for mounting the top plate 60 on the ends 36 of the stepped columns 34 in the same manner as the top plate 40. The top plate 60 has a small through-bore 64 centrally positioned to be in alignment with the ram 20 when the plate 60 is installed on the basic press 10. In this embodiment five threaded bores 66 are provided in the top plate 60, each at the same radial distance from the center of the bore 64 and angularly spaced at seventy two degrees from each adjacent bore 66. The bores 66 are for the removable mounting of reloading tools, such as dies.

A shell plate holder 76 rotatably supports a shell plate 78. A ram adaptor 80 configured to mate with the end 28 of the ram is fitted to the shell plate holder 76. The shell plate holder 76 and the ram adapter 80 are secured to the end 28 of the ram 20 as by bolting. The shell plate 78 is rotatably mounted to the shell plate holder 76 by a shoulder bolt 82 extended through center bores in the shell plate 78 and holder 76 and threadably installed in bore 81 of adapter 80. As shown in the figure, the shell plate 78 has multiple cartridge case holding slots 84. The slots 84 are radially positioned in reference to the center of the shell plate 78 and are angularly spaced at seventy two degrees. An index wheel 88 bolted to the top of the shell plate 78 is utilized to index the shell plate 78 on the shell plate holder 76. A spring and ball assembly 89, 90 fitting in a bore 92 of the shell plate holder urges the ball 90 into conventional detents (not shown)

formed on the underside of the shell plate 78 to locate and provide a positive feel of each index position. The detents are out of view in the drawing but are similar to the detents as shown in the previously referenced U.S. Pat. No. 4,841,831. An index locating pin 94 projects up from the base 12 and extends through hole 17 in plate 76 into one of the holes 85 in plate 78. This insures that the shell plate 78 is accurately and positively indexed. The top plate 60 may be paired with a number of different shell plates 78 which are interchangeably mountable on the shell plate holder 76. Thus when changing to a different caliber of cartridge case requiring a different shell holder, only the shell plate 78 need be changed.

It will be appreciated that some of the components normally affixed to the shell plate holder have not been detailed. These are considered to be known to the art and it is not deemed necessary to detail them. For example, the shell plate holder has facilities to mount case retention springs, a case ejection spring, a case detecting arm, the primer transfer mechanism and so forth. Some of these components can be found in the commonly assigned U.S. Pat. No. 5,024,135. (Note also that FIG. 5 illustrates certain of the components, e.g., the case detecting arm 122.)

Figure 5:
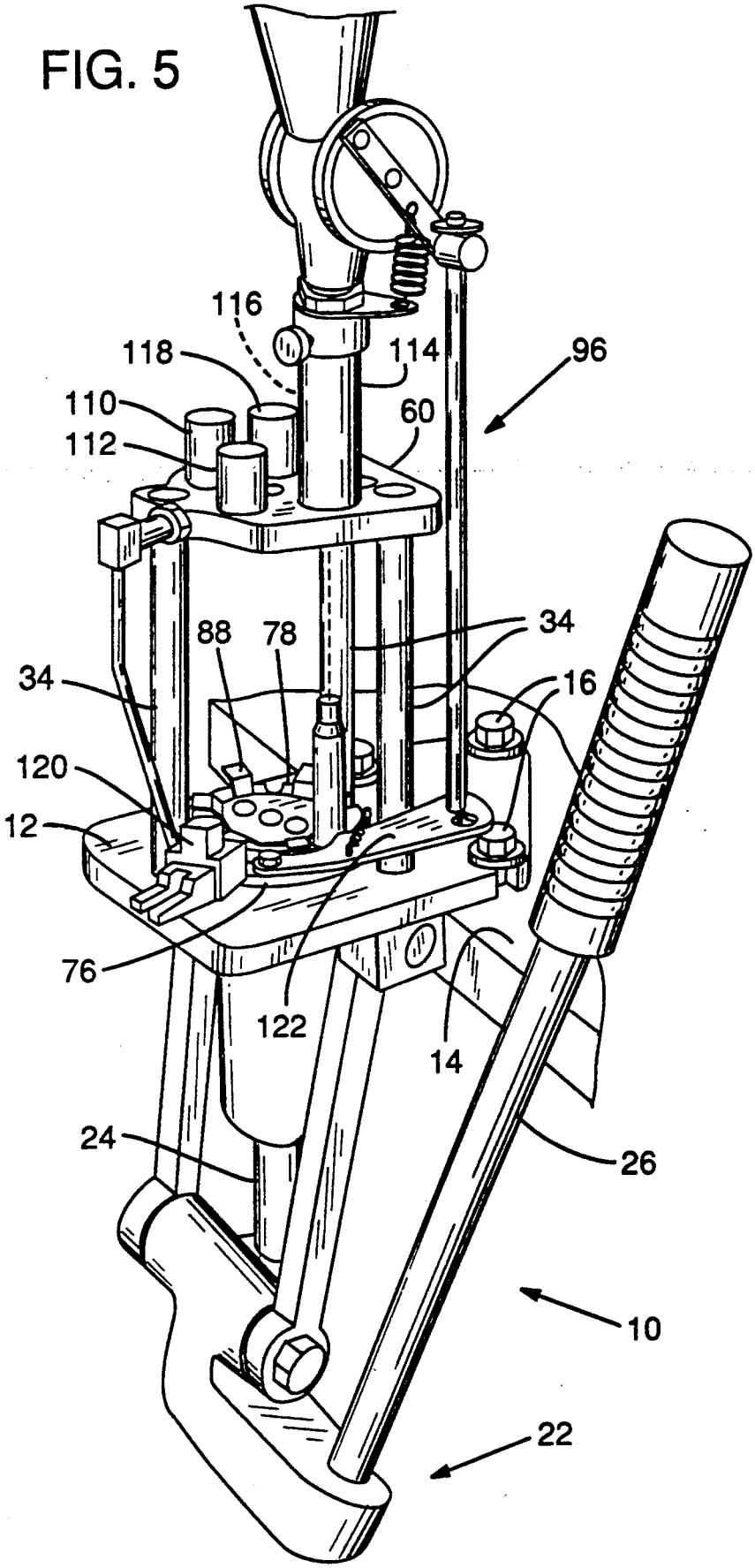
FIG. 5 is a view of the press of FIG. 1 arranged for multiple stations and arranged for manual indexing.

Refer now to FIG. 5 of the drawings which illustrates an assembled multiple station press 96 with manual indexing. As shown in the figure, the assembly of the shell plate holder 76 and the shell plate 78 and ancillary equipment ar mounted on the end 28 of the ram 20 of the basic press 10. The top plate 60 is installed on the upper ends 36 of the columns 34. The shell plate 78 as previously mentioned is rotatably mounted o the shell plate holder 76 and is manually indexable by use of the index wheel 88. The spring and ball assembly 89, 90 provides a positive feel for each index location which in this embodiment is at seventy two degree increments. Each index location aligns the holding slots 84 of the shell plate 78 with the bores 66 of the top plate 60. Each index location thus aligns the cartridge holding slots 84, and therefore the cartridges held in the slots, with the reloading tools mounted in the bores 66 of the top plate 60. A cartridge case held in one of the slots 84 may be presented to each of the reloading tools held in the bores 66 by sequentially indexing the shell plate one index increment at a time.

The multiple station press 96 is shown with typical tooling to perform all of the operations necessary to reload a cartridge case in a single setup. In this embodiment, a lubricating and decapping die 110 is in station one, a resizing die 112 is in station two, a controlled powder dispenser 114 similar to the dispenser disclosed in the previously referenced U.S. Pat. No. 5,024,135 is in station three, a powder verification die 116 (out of view) is in station four and a bullet seating die 118 is in station five. A known primer transfer mechanism, generally indicated by the numeral 120, is also fitted to the pres 96.

A cartridge case is inserted in the holding slot of the shell plate in station one, the ram is moved upwardly which forces the case into the lubricating and decapping die 110 where the case is lubricated on its periphery and the spent primer is ejected. The ram is lowered toward the bottom of the stroke and the shell plate is indexed manually one index increment by use of the index wheel 88. This places the first case at station two and another case is inserted in station one. The ram is lowered toward the bottom of its stroke and in so doing the locating pin 94 positively locates the index position of the shell plate which will accurately align the primer pocket of the first case with primer inserting mechanism. The spring 89 biasing ball 90 provides a positive feel of index position but may not accurately position the shell plate since the ball may not fully seat in the detent. Therefore, to insure accuracy of index location, an index pin 94 is utilized. The pin extends through a bore 17 in the shell plate holder and the tapered end of the pin protrudes through a hole 85 in the shell plate to positively locate the index position of the shell plate. As the ram is lowered further, a new primer is installed in the primer pocket of the cartridge case. The ram is elevated toward the top of its stroke and the cases in station one and two will be forced into their corresponding dies, e.g., where the case in station one is lubricated and deprimed and the case is station two is resized. The ram is once again lowered, the shell plate is once again manually indexed and another case is inserted into station one. As the ram is lowered further a primer will be installed in the second case. The first case is now in station three and will enter the powder dispenser 114 as the ram is elevated and powder will be dispensed into the case. The powder dispensing mechanism includes a case detecting arm 122 that disengages the powder dispenser when a case is not present in station three. Since a case is now present in station three the case detecting arm will engage to actuate the powder dispenser when the ram elevates the case to the powder dispenser. Those skilled in the art will readily recognize that the cycling of the press continues, indexing the shell plate one increment with each cycle, to thus present the first case and subsequent cases to all stations sequentially with a reloading operation or operations being performed at each station until all cases to be reloaded have been cycled through the press.

Figure 6:
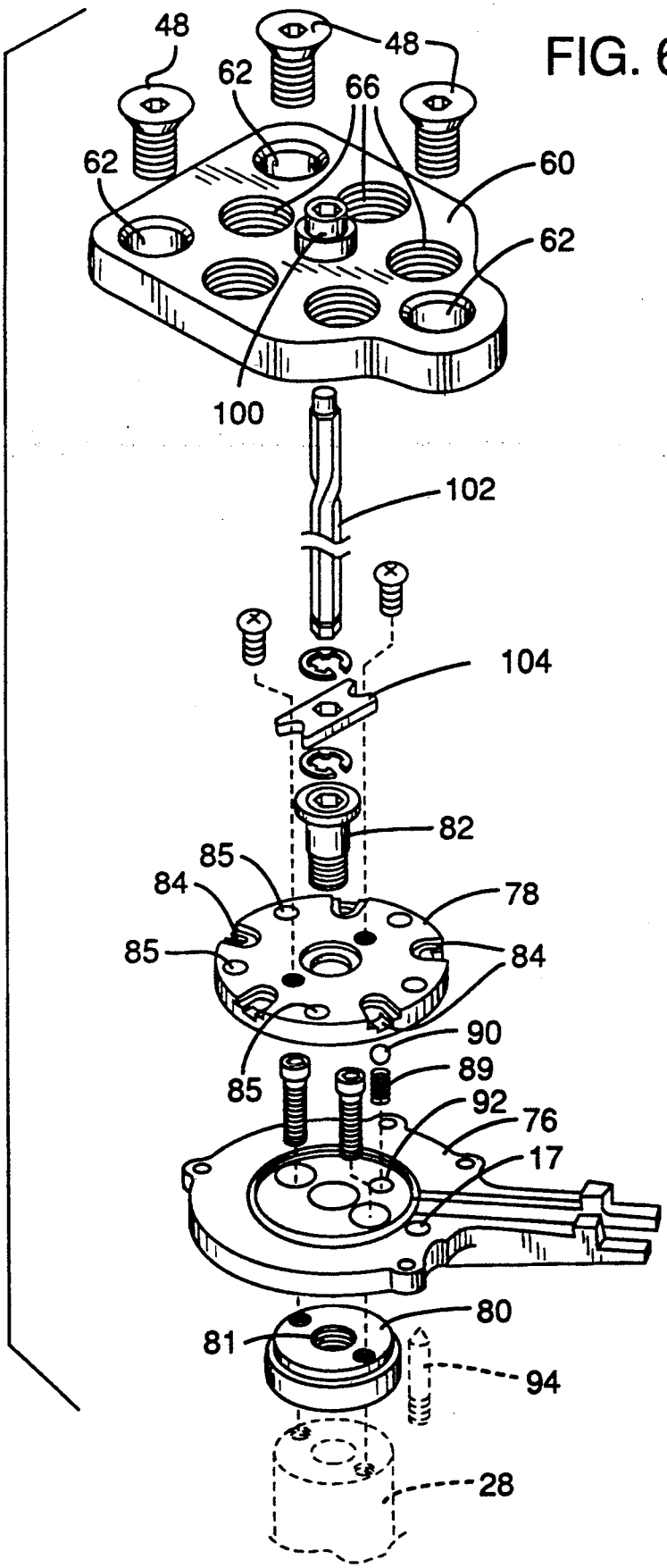
FIG. 6 is a view of a multiple stage top plate, shell plate holder and shell plate with automatic indexing mechanism mountable to the press of FIG. 1.

Refer now to FIG. 6 of the drawings which illustrates a conversion set which is added to the basic press 10 to complete the assembly of a multiple station press 98 with automatic indexing. As shown in the figure, the kit comprises the same top plate 60, shell plate 78, shell plate holder 76, and ram adaptor 80 as is utilized in the conversion set for the multiple station press 96 with manual indexing shown in FIG. 4. In addition, a one way drive clutch assembly 100 is installed in the center bore 64 of the top plate 60. A hexagon drive rod 102 having a spiral twist near its upper end is slidably mountable in a bushing of the one way drive clutch and has a connecting plate 104 affixed to its lower end as shown. The connecting plate is attachable to the shell plate 78 as by threaded fasteners.

Figure 7:
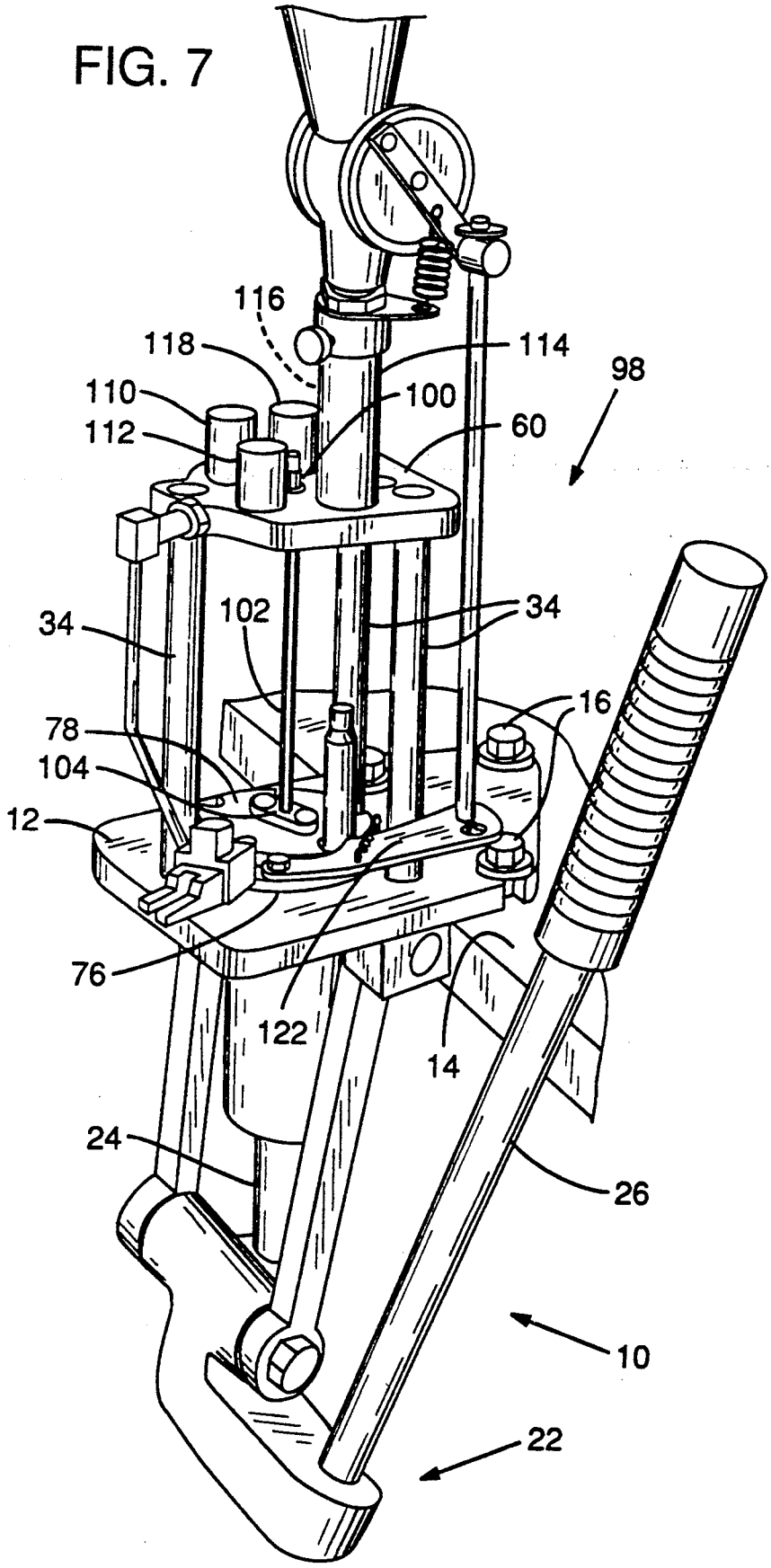
FIG. 7 is a view of the press of FIG. 1 arranged for multiple stations and having automatic indexing.

Refer now to FIG. 7 of the drawings. It illustrates the conversion set of FIG. 6 mounted to the basic press 10 to complete the assembly of a multiple stage press 98 with automatic indexing. The top plate 60 with the on way drive clutch assembly 100 is installed on the columns 34, and the shell plate 78 and shell plate holder assembly are attached to the ram in the same manner as previously described. The drive rod 102 is slidably mounted in the drive bushing of the clutch 100 and the connecting plate 104 affixed to the lower end of the drive rod is attached to the shell plate 78. The clutch mechanism 100 permits rotation of its bushing in one direction only and is so mounted in the top plate 60 so as to force the rod 102 to rotate as the twist of the rod traverses the bushing on the down stroke of the ram. The rod coupled to the shell plate 78 will index the shell plate as the rod is rotated. On the upstroke of the ram, the drive bushing is free to rotate in the opposite direction and thus the bushing will be rotated instead of the drive rod. The indexing mechanism utilized is similar to the indexing mechanism disclosed in the commonly assigned U.S. Pat. No. 4,841,831. The indexing mechanism is of course arranged for five stations instead of four and thus has an index increment of seventy-two degrees.

The multiple station press 98 as illustrated in FIG. 7 is tooled in the same manner as the press illustrated in FIG. 5. The operating cycles are the same excepting that the shell plate is automatically indexed as the ram nears the bottom of its stroke.

In reference to press 98, a cartridge case is inserted into station one of the press with the ram near or at the bottom of its stroke. The ram is moved upwardly to force the case into the lubricating and decapping die 110 where the case is lubricated on its exterior and the spent primer is ejected. The ram is then lowered and as the twist of the rod 102 traverses the one way drive clutch, the shell plate 78 is indexed which advances the first cartridge to station two. A primer is installed in the primer pocket of cartridge one during this procedure and the press is continued through its cycle with a cartridge case inserted in station one at each cycle until all the cases have been reloaded.

The utilization of the basic press 10 in combination with an appropriate conversion set installed on the press 10 provides an assembly of a reloading press that has defined functional capabilities. By interchanging the conversion sets, the functional capability of the assembled press may be altered. That is, the basic press 10 in combination with the conversion set illustrated in FIG. 2 defines a single station press which may be converted or altered to a multiple station press by merely removing the conversion set illustrated in FIG. 2 and installing either the conversion set illustrated in FIG. 4 or the conversion set illustrated in FIG. 6. A press arranged as a multiple station press may similarly be changed to a single station press by the appropriate interchange of conversion sets. Also, while a complete conversion set has been illustrated in FIG. 6 to be added to the basic press 10 to provide a multiple station press with automatic indexing, it is apparent that if a user has an assembled press with manual indexing, the user would merely remove the index wheel, and install the one way clutch mechanism with a drive rod to the top plate and connect the drive rod to the shell plate to convert from manual indexing to automatic indexing. A full conversion set is shown for all configurations, since any one of them may be the users initial choice for an assembled press. The user may at any time convert the press from any one of the configurations to another. The interchangeability of the conversion sets and the interchange of components between conversion sets reduces tooling costs.

It will be apparent to those skilled in the art that modifications and variations may be made without departing from the true spirit and scope of the inventions. The present invention may be applied to other press configurations such as in-line multiple station presses, presses which index or relocate the reloading tools instead of the cartridge cases and others. The invention is therefor not to be limited to the embodiments illustrated and described but is to be determined by the appended claims.

I claim:

1. A system wherein a spent cartridge case reloader is alternatively adaptable to single stage and multiple state reloading operations from a single common foundation, comprising;

a base, a ram slidably mounted in said base for reciprocal vertical movement, a plurality of support columns fixedly secured to said base and extended above said base, and an actuator for actuating sliding movement of said ram relative to said base and said support columns, a first tool holder plate and a second tool holder plate, releasable mated fasteners provided on said columns and said first and second tool holder plates for alternatively mounting said first and second tool holder plates in spaced overhead relation to said base in the path of the reciprocating ram;

a first shell holder device and a second shell holder device, releasable mated fasteners provided on said ram and said first and second shell holder devices for alternatively mounting said first and second shell holder devices to said ram, said first tool holder plate and said first shell holder device both dedicated to single stage reloading operation and when mounted to the columns and ram respectively, providing said reloader with single stage reloading capability, only, wherein the shell holder device holds a single cartridge on the end of the ram, and the tool holder device holds a single tool in overhead alignment with said single cartridge, said tool holder adapted for selectively and alternatively holding a selection of individual tools for performing sequential reloading operations on the cartridge held in the first shell holder device, and said second tool holder plate and said second shell holder device both dedicated to multiple stage reloading operation and when mounted to the columns and ram respectively, providing said reloader with multiple stage reloading capabilities, said second tool holder plate including fixed multiple stations for simultaneously holding a plurality of selected tools, and said second shell holder device including a rotatable shell holding plate adapted to hold a plurality of cartridges to be reloaded that are rotatably mounted to said ram, and a ratchet mechanism for sequential positioning of the rotatable shell holding plate for simultaneously aligning cartridges in the shell holding plate with the tools in the multiple stations of the tool holding plate, and said ratchet mechanism being selected from one of manual operation and automatic operation.

2. A system as defined in claim 1, which further includes a manually operable member and an automatically operable member alternatively interconnected to the shell holding plate of said second shell holder device whereby the second shell holder device is convertible as between manual and automatic operation.

3. A system as defined in claim 2 wherein a one-way drive clutch is mounted to the tool holder plate and an indexing rod is mounted to the shell holder plate and is slidably inserted through the clutch whereby reciprocation of the ram forces the indexing tool through the one-way drive clutch and automatic indexing of the shell holder plate.

* * * * *